United States Patent [19]

Habdas

[11] 4,004,634

[45] Jan. 25, 1977

[54] AUTOMOTIVE OIL COOLER

[75] Inventor: Edward P. Habdas, Dearborn Heights, Mich.

[73] Assignee: Universal Oil Products Company, Des Plaines, Ill.

[22] Filed: May 6, 1975

[21] Appl. No.: 574,989

[52] U.S. Cl. ..... 165/155; 165/141; 184/104 B

[51] Int. Cl.[2] ..... F28D 7/10

[58] Field of Search ..... 165/140, 141, 154, 155, 165/156; 184/104 B

[56] References Cited

UNITED STATES PATENTS

| | | | |
|---|---|---|---|
| 1,689,461 | 10/1928 | Taylor et al. | 165/154 |
| 2,752,128 | 6/1956 | Dedo | 165/155 |
| 3,177,936 | 4/1965 | Walter | 165/109 T |
| 3,235,947 | 2/1966 | Söhlemann | 165/154 |
| 3,384,154 | 5/1968 | Milton | 165/154 |
| 3,643,733 | 2/1972 | Hall et al. | 165/154 |
| 3,829,285 | 8/1974 | Beck | 165/154 |

FOREIGN PATENTS OR APPLICATIONS

| | | | |
|---|---|---|---|
| 640,532 | 1/1928 | France | 165/154 |
| 615,937 | 1/1949 | United Kingdom | 165/154 |

*Primary Examiner*—Albert W. Davis, Jr.
*Assistant Examiner*—Sheldon Richter
*Attorney, Agent, or Firm*—James R. Hoatson, Jr.; Barry L. Clark; William H. Page, II

[57] ABSTRACT

Submerged oil cooler for automotive vehicles requires only two principal parts but can provide more heat transfer at a lower pressure drop than conventional oil coolers which utilize three principal parts. In a preferred embodiment, an outer tube having a plurality of longitudinal flutes which are periodically transversely indented is press fit over an inner tube having a helically finned outer surface. The tubes are sealed at their ends so as to define an extended annular flow channel for oil between the tubes, while permitting engine coolant in which the cooler is submerged to flow through the inner tube. A modified arrangement substitutes corrugated tube for the finned inner tube with a resulting cost saving in material but with a small increase in pressure drop and a small loss in heat transfer efficiency.

10 Claims, 5 Drawing Figures

AUTOMOTIVE OIL COOLER

BACKGROUND OF THE INVENTION

Liquid-to-liquid heat exchangers for use submerged in an automobile radiator for transferring heat from the transmission oil to the engine liquid coolant are generally constructed of three major items, a cylindrical outer tube, a cylindrical inner tube, and a turbulator constructed from formed strip sandwiched between the tubes. There are a number of disadvantages to this construction, as for example: there are three separate major items to manufacture and assemble; the additional heat transfer area provided by the turbulator strip communicates to the heat sink (engine coolant) through a mechanical bond with resulting thermal resistance, the value of which depends upon the pressure exerted between the components; the heat exchanger surface presented to the engine coolant is smooth and has no enhanced heat transfer characteristics; and finally, the increased heat transfer characteristics are gained by turbulating the entire fluid path with an attendant, and undesirable, pressure drop increase.

The aforementioned disadvantages of existing oil coolers are not inconsequential. Being able to obtain equivalent performance at a lower cost is always desirable. However, in the case of some automotive applications, the use of smaller engines and the desire for lower hood profiles has resulted in the adoption of radiators of a very small size which place absolute limits on the amount of space available for a submerged oil cooler. A typical oil cooler for a small car has a maximum length of about 11 inches and an outside diameter of about 1 inch. A cooler made in such a size in the conventional manner is adequate for most purposes but can prove to have insufficient oil cooling capacity for certain extreme driving conditions which place additional demands on the transmission. It would thus be desirable to have an oil cooler which could transfer more heat than conventional coolers of the same size, do so with the same or a lesser degree of pressure drop, and do so at the same or a lower cost than present coolers.

SUMMARY OF THE INVENTION

It is among the objects of the present invention to provide an improved oil cooler which is more efficient than prior art coolers and/or cheaper to produce than prior art coolers. A preferred embodiment utilizing an inside tube having fins on its outer surface is briefly described in the Abstract as is a modification wherein the inner tube is corrugated. The modified corrugated inner tube embodiment costs less to produce than the preferred finned tube embodiment or the prior art embodiment since it uses less material. However, its pressure drop in a single unit that was tested was found to be slightly inferior to a conventional turbulator type cooler while its heat transfer performance was found to vary from slightly worse than a conventional cooler at an oil flow rate of 1 gallon per minute to slightly better at an oil flow rate of 2 gallons per minute.

DESCRIPTION OF THE PREFERRED EMBODIMENT

Figure 1:
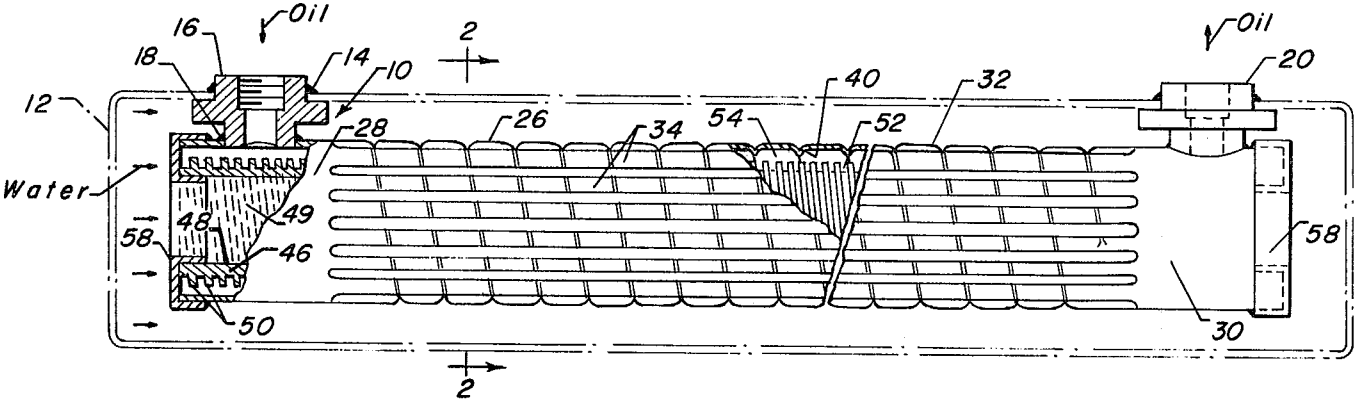
FIG. 1 is a fragmentary, partially sectioned top view of a preferred embodiment of an improved oil cooler shown in operative relationship with a radiator lower tank element (shown in phantom) in which it is mounted.

Referring to FIG. 1, my improved submerged oil cooler indicated generally at 10 is shown in operative relation to a radiator lower tank element 12 (indicated in phantom lines) in which it is mounted and to which it is sealed by appropriate fastening means such as solder bead 14. Mounted at one end of the oil cooler 10 is an inlet member 16 having internal threads for receiving a transmission oil cooling line (not shown). The inlet member is preferably fastened to the oil cooler by a solder bead 18. Similarly, a transmission oil outlet member 20 is soldered or brazed to the tank element 12. The inlet and outlet fittings 16,20 are attached to a fluted tubular shell member 26 at smooth end portions 28,30 thereof. The shell member 26 includes a central fluted portion 32 between the smooth end portions 28,30, the fluted portion being defined by a plurality of flutes 34 having outer crest portions 36 and inner root portions 38. The outer surface of central fluted portion 32 is helically corrugated so that the outer crest portions 36 of the flutes 34 are periodically indented at 40 along their axial length.

An inner tube 46 is press fit into the outer tube or shell member 26 so as to form a two-tube composite. The inner tube 46 has a smooth inner surface 48 which defines the interior wall of central aperture 49. The aperture 49 passes through the entire length of the cooler 10 and is adapted to receive cooling water within the radiator flowing in the direction of the arrows toward the radiator outlet (not shown). The outer surface of inner tube 46 has helical fins 50 which provide an extended heat transfer surface in contact with transmission oil flowing through the oil distribution chamber 52 defined by the fins 50 on the inner tube 46 and the internal walls of the outer shell member 26 and its flutes 34. As oil flows through the chamber 52 from inlet 16 to outlet 20, it moves through a series of short longitudinal axial channels or chambers 54 which are defined by axially adjacent indentations 40.

The improved heat exchanger described hereinabove provides a unique structure which maximizes heat transfer while minimizing pressure drop. The outer tube 26 may have, for example, 12 to 24 flutes 34, which, for a 1 inch O.D. cooler have a depth of about 0.040 in. to 0.100 in. As can be seen in the end view in FIG. 2, these flutes 34 each represent an axial flow path so as to be somewhat similar to 12 to 24 individual, very small diameter tubes in parallel. This is advantageous for two reasons: First, the surface area of the outer tube 26 in contact with the engine coolant is increased up to 50% over that for a smooth tube. At the same time, a proportional increase in the surface area in contact with the oil is also obtained and since this surface is integral with the shell 26, no bond resistance is possible. Secondly, the oil flow in coolers of this type is generally characterized as streamline flow for which typical heat transfer equations indicate that the use of small diameter tubes will increase the heat transfer coefficient. Referring to FIG. 1, it can be seen that the outer tube 26, in addition to the flutes 34 has a helical corrugation 40 which may have a pitch of from 0.2 in. to 0.8 in. and a depth from 0.030 in. to 0.090 in., depending upon the flute dimensions chosen. Heat exchangers for oil cooling have been disclosed in the prior art which have helical patterns of some type in order to cause the oil to flow helically along the cooler to increase the length of its flow path. The helical corrugations 40 are not for this purpose. In fact, the corrugation is such that indentations 40 occur only on the flute crests 36 and act as a series of periodic restrictions along the length of a small diameter tube which define the short channel segments 54. The purpose of the restrictions is to force the oil flow into a turbulent or near turbulent flow pattern for thermal mixing of the oil stream. This effect becomes apparent when one considers typical heat transfer correlations which show that the heat transfer coefficient is reduced as the tube length increases. The reason that this occurs is because in streamline flow there is no oil mixing as it flows down the tube. Hence the heat transferred from the bulk oil stream must be conducted through an increasingly thicker layer of low thermal conductivity oil. The indentations 40 in effect cause the long flutes 34 to act as a series of very short tubes 54, thus increasing the heat transfer coefficient. While the indentations 40 force the oil to mix thermally for better heat transfer, they also cause an increase in pressure drop; therefore the corrugation pitch (distance between indentations 40) is selected to yield the desired heat transfer at the lowest pressure drop. The oil flow through an individual flute 34 can thus be forced into a controlled pattern of turbulent and streamline flow in contrast to prior types of coolers which turbulate the oil for their entire length.

As shown in FIG. 1, instead of a smooth tube forming the inner wall of the cooler as in conventional designs, a helically finned tube 46 is used. This is of a type such as made commercially by Wolverine Division of Universal Oil Products Company and known as Trufin. Tubes of this type are characterized by having a finned surface area three to five times greater than the inside area and by having the fins formed integrally from the tube wall so that there is no resulting thermal bond resistance. In contrast with conventional cooler designs which require an expansion process to mechanically force the outer tube, turbulator and inner tube into intimate contact, the finned tube 46 merely requires a slight press fit into the outer shell 26. The finned tube 46 is believed to function in two simultaneous modes. Since the finned surface acts as one side of the channel 52 partially formed by the flute 34, oil will flow axially along the fins 50. This flow will produce a heat transfer coefficient that will act on all or part of the surface area presented by the fins depending upon how deeply into the fin grooves the axial oil stream penetrates. The second mode will be caused by a helical flow component of the oil. Since the number of fins per inch will be relatively high, approximately 11 to 26, the flow resistance along this path will be extremely high. This path, however, is in parallel with the flow path axially down the flute and therefore some flow will be produced. The magnitude will depend upon the fins per inch selected on the fin tube and the fluting and corrugation dimensions chosen for the outer shell. Because of the high value of surface area represented by the finned configuration, this helical flow will cause a transfer of heat through the inner tube wall.

From the foregoing description it is apparent that the three major components of prior art turbulator type coolers have been replaced by two, and the assembly has eliminated the expansion required for a mechanical bond. Coolers of this type are generally mounted horizontally in the lower tank 12 of an automobile radiator. In this position the engine coolant, as it flows down through the radiator tubes (not shown), impinges on the outer shell 26 of the cooler in addition to having an axial flow component as it flows to the radiator outlet. It is well known in the heat transfer art that surface discontinuities such as those presented by the flutes 34 and corrugations 40 will enhance the heat transfer properties of the disclosed cooler when compared with the smooth surface presented by conventional coolers.

FIG. 1 shows caps 58 closing off the ends of tubes 26,46 which define the oil flow chamber 52. However, such caps are not essential and other well-known means can be used, as for example, the ends of the finned tube 46 can be expanded and brazed to the outer shell 26.

Figure 2:
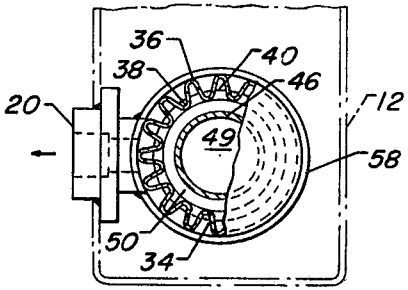
FIG. 2 is a sectional view taken on the line 2—2 of FIG. 1.
Figure 3:
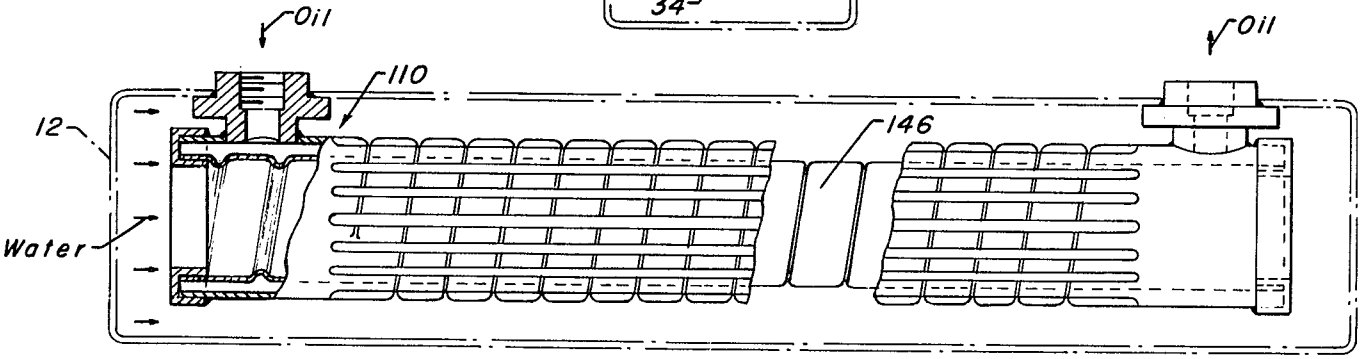
FIG. 3 is a fragmentary, partially sectioned top view of a modification of the cooler shown in FIGS. 1 and 2.

FIG. 3 shows an oil cooler 110 which is a modification to the cooler of FIGS. 1 and 2, the only difference being that a corrugated tube 146 has been substituted for the finned tube 46 as the inside component. The operating principles remain the same except that the large amount of surface presented by the fins 50 is reduced to essentially that of a prime surface tube and the flow area for the helical oil path is also smaller. Essentially this reduces the heat transfer properties and increases the pressure drop. However, the corrugated tube 146 contains less metal and is easier to fabricate, and therefore represents a more economical cooler which can be used where heat transfer and pressure drop requirements are less stringent.

Figure 5:
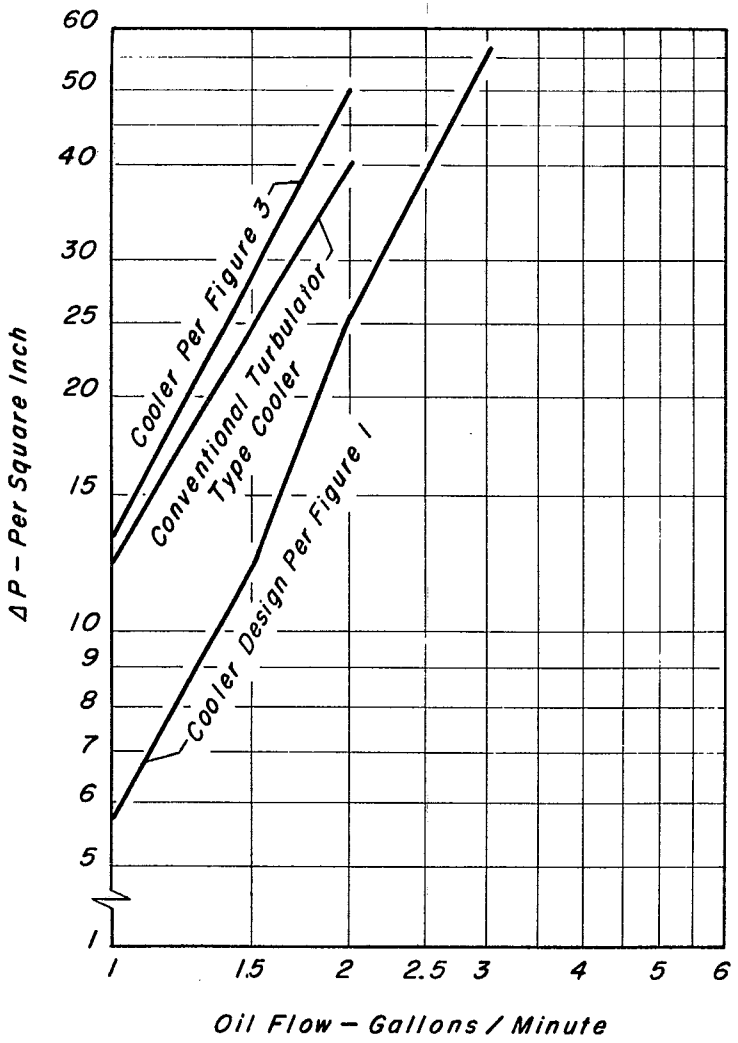
FIG. 5 is a graph similar to FIG. 4 except that it plots pressure drop, $\Delta$ P, against the rate of oil flow.
Figure 4:
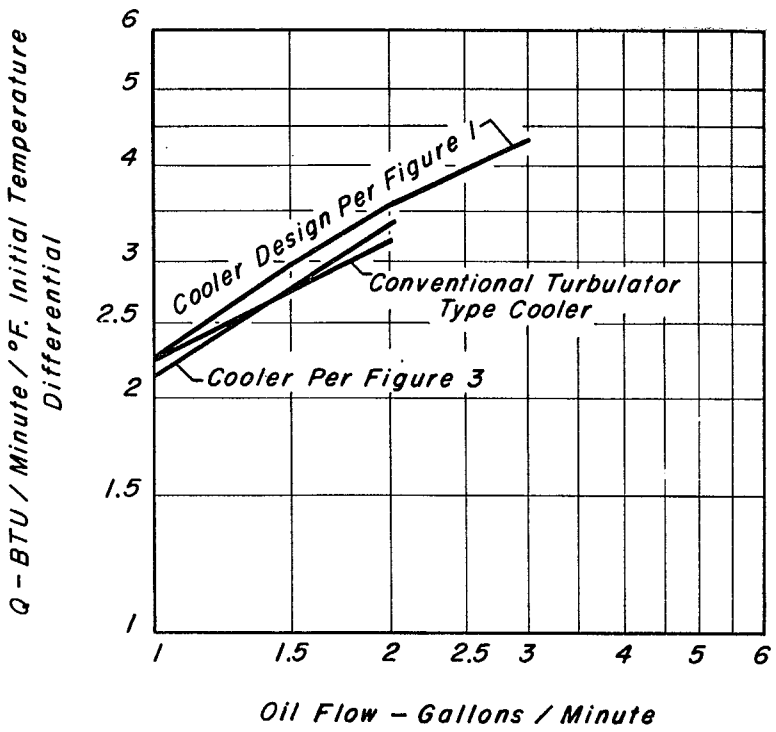
FIG. 4 is a graph plotting the heat load, Q, against the rate of oil flow through the cooler and compares the coolers of FIGS. 1 and 3 to a conventional submerged turbulator type cooler.

FIGS. 4 and 5 show the results of heat transfer (FIG. 4) and pressure drop (FIG. 5) for three coolers. The cooler designed per FIG. 1 consisted of a shell 26 having 16 flutes 34, 0.070 in. deep with a corrugation 0.036 in. deep at a pitch of 0.2 in. The fin tube insert 46 had 26 fins per inch. These values represent an arbitrary selection and may or may not be the values for optimum performance. The cooler designed per FIG. 3 had 16 flutes, 0.070 in. deep, with a corrugation 0.040 in. deep at a pitch of 0.2 in. The fin tube insert 46 of FIG. 1 was replaced by a tube 146 corrugated to a depth of 0.030 in. at a pitch of 0.25 in. The conventional cooler was a commercially available unit with a full length strip type turbulator compressed between an inner and outer shell. All three units had oil fittings spaced at 10 inches, an overall length of approximately 11 inches, and an OD of 1 inch.

The test consisted of using transmission type oil entering the cooler at 240° F at rates of 1 to 3 gallons per minute. The heat sink was a high flow of 48 gallons per minute of 180° F water flowing axially over the cooler. The heat transferred from the oil was calculated from measurements of the oil temperature difference, flow rate, and specific heat. This heat value, Q, divided by the initial temperature difference of the oil and water inlet temperatures, 60° F, is the abscissa value on FIG. 4 for the thermal performance. The pressure drop value on FIG. 5 is a direct measurement in pounds per square inch at the various oil flow rates.

As seen in FIGS. 4 and 5, the cooler designed per FIG. 1 has higher heat transfer than the other two models and yet presents a lower pressure drop. With replacement of the fin tube 46 with corrugated tube 146 as shown in FIG. 3, the thermal performance drops to approximately the level of the conventional design while the pressure drop has increased slightly.

I claim as my invention:

1. In a submerged oil cooler for automotive vehicles comprising a hollow inner length of tubing through which engine coolant may flow and an outer length of tubing sealed at its ends to the inner tubing and having an inner surface which cooperates with the outer surface of the inner length of tubing to define a generally annular flow passage for oil which may pass through inlet and outlet fittings at opposed ends of the cooler, the improvement wherein said inner length of tubing includes a helically convoluted outer surface and said outer length of tubing includes a plurality of generally axially extending flutes which engage said helically convoluted outer surface, the crests of said flutes being periodically transversely indented along the axial length thereof to a depth less than the depth of the flutes.

2. A submerged oil cooler in accordance with claim 1 wherein the inner length of tubing has helically convoluted, integral fins extending from its outer surface.

3. A submerged oil cooler in accordance with claim 1 wherein the inner length of tubing has helically convoluted corrugations on its outer surface.

4. A submerged oil cooler in accordance with claim 1 wherein said plurality of generally axially extending flutes are helically corrugated to form transverse indentations in said flutes.

5. A submerged oil cooler in accordance with claim 1 wherein said outer length of tubing contains between about 12 and 24 flutes.

6. A submerged oil cooler in accordance with claim 1 wherein said outer tubing has about 16 flutes which are about 0.070 in. deep, the crests of said flutes being indented about 0.036 in. deep at an axial pitch of about 0.2 in., and wherein said inner length of tubing includes about 26 integral, helically convoluted fins per inch on its outer surface.

7. A submerged oil cooler in accordance with claim 1 wherein said flutes have a depth of from about 0.040–0.100 inches and are indented to a depth of about 0.030–0.090 inches.

8. A submerged oil cooler in accordance with claim 7 wherein said indentations are axially spaced at a pitch of about 0.2–0.8 inches.

9. A submerged oil cooler in accordance with claim 8 wherein said inner length of tubing includes from about 11–26 integral fins per inch of length.

10. A submerged oil cooler in accordance with claim 8 wherein said inner length of tubing is generally smooth except for a helical corrugation in its wall having a depth of about 0.030–0.065 inches and a pitch of about 0.25–0.75 inches.

* * * * *